US007584013B2

(12) United States Patent
Tran et al.

(10) Patent No.: US 7,584,013 B2
(45) Date of Patent: Sep. 1, 2009

(54) METHOD AND APPARATUS FOR ACHIEVING A FAST CROSS DIRECTION CALIPER CONTROL RECOVERY TIME

(75) Inventors: Peter Quang Tran, Dublin, OH (US); Timothy Andrew Mast, Dublin, OH (US)

(73) Assignee: ABB Ltd., Dundalk (IE)

( * ) Notice: Subject to any disclaimer, the term of this patent is extended or adjusted under 35 U.S.C. 154(b) by 364 days.

(21) Appl. No.: 11/414,922

(22) Filed: May 1, 2006

(65) Prior Publication Data

US 2007/0255445 A1 Nov. 1, 2007

(51) Int. Cl.
*G06F 7/66* (2006.01)

(52) U.S. Cl. ..... 700/128; 700/127; 700/129; 162/253; 162/262; 162/263

(58) Field of Classification Search ..... 700/127, 700/128, 129, 28, 37, 41; 162/198, 232, 162/252, 262, 263, 253; 702/170
See application file for complete search history.

(56) References Cited

U.S. PATENT DOCUMENTS 5,583,782 A * 12/1996 Heaven et al. ..... 700/129
5,893,055 A * 4/1999 Chen ..... 700/128
6,564,117 B1 * 5/2003 Chen et al. ..... 700/129
6,755,940 B2 * 6/2004 Lin et al. ..... 162/252
6,799,082 B2 * 9/2004 Sasaki ..... 700/128
7,300,548 B2 * 11/2007 Tran et al. ..... 162/198
2004/0221978 A1 * 11/2004 Tran et al. ..... 162/198

* cited by examiner

*Primary Examiner*—Charles R Kasenge
(74) *Attorney, Agent, or Firm*—Michael M. Rickin

(57) ABSTRACT

Fast cross direction caliper control recovery time in a sheet making machine during startup of the machine after a sheet break is achieved provided that a preselected time duration measured from the occurrence of the sheet break to the clearing of sheet break has elapsed. One or both of calender stack conditioning and conditioning of a measurement from a sensor for measuring caliper of the sheet, both with feedback CD control suspended, can be selectably performed. These operations can be performed concurrently if the selected time duration for both are identical. A closed loop change in a set of control tuning parameters of a PI controller providing feedback caliper control of actuators associated with the calender stack can be performed after either or both of the other operations are performed.

19 Claims, 8 Drawing Sheets

METHOD AND APPARATUS FOR ACHIEVING A FAST CROSS DIRECTION CALIPER CONTROL RECOVERY TIME

FIELD OF THE INVENTION

This invention relates to the making of a sheet material such as paper and more particularly to the control of the caliper profile of the sheet material in the direction across the web known as the cross direction (CD).

DESCRIPTION OF THE PRIOR ART

The thickness of a sheet material such as for example a paper sheet or web is referred to as caliper and the caliper profile refers to the thickness profile in the CD. Caliper profiles are measured by scanning devices located downstream of a series of rolls arranged in parallel, one above the other in a stack. The sheet material passes through the space between adjacent rolls known as a nip. These rolls are generally defined as calender rolls and the caliper profile is changed by adjusting the spacing between adjacent rolls, and by controlling the nip pressure and the surface roll temperature. These two control systems are interdependent and both systems are able to control in a series of zones along the length of the rolls to ensure that the paper sheets have a substantially uniform caliper profile across the paper width.

The two main objectives of cross-direction (CD) caliper control are to provide good profile control in steady-state operation and to achieve fast, stable performance during startup situations. As used herein "startup" of the paper machine is defined by the threading of a sheet material through the stack of calender rolls and the clearing of a sheetbreak detector at or near the location where the caliper profile is measured. The success of delivering both objectives has been proven time and time again with currently available CD caliper control systems, as evident by the large number of installed CD caliper control systems.

For example, the CD caliper control in the quality control (QC) system available from ABB has been successful in providing the two main objectives of CD caliper control. By offering proportional-integral (PI) control actions in the calculation of the final CD actuator setpoints, the CD caliper control in the ABB QC system provides a stable algorithm to address the long time constant typical of a caliper profile response to the CD actuator. However, the algorithm does not differentiate between caliper profile conditions at startup versus those in steady state. Thus if in use the PI-control is tuned for aggressive P-action to compensate for sudden, large changes in the profile, as occur at startup of a machine that same aggressiveness would also be applied in the steady state where the profile error is likely to be stable and uniform. Such aggressiveness may not be desirable in the steady state.

There are CD caliper application conditions that make it difficult for a CD caliper control relying solely on feedback control to quickly restore control performance at startup of the machine and usually result in either addition of special software or operational changes to the QC system. These application conditions during startup of a paper machine are:

a. the calender stack condition will depend on how long the paper machine has been down. The longer the paper machine is down, the colder the calender stack and thus more effort is needed from the CD actuator to restore the stack to a previous steady-state performance level. The thermal inertia of the calender stack results in a caliper profile "open-loop response time" to the CD caliper actuator that is typically 7.5 to 10 minutes. One common definition of open-loop response time, which is used herein, is the time it takes for a process value (in this case, the caliper profile) to achieve 63% of its final value as it reacts to a step change in a manipulated variable (in this case, the CD caliper actuator). An extension to the above definition is that it takes four (4) times the open-loop response time for the process value to achieve 98% of its final value as it reacts to a step change in a manipulated variable. For example, if the caliper profile open-loop response time is 10 minutes then it takes 40 minutes for the caliper profile to substantially complete its change.

b. travel of the paper web may not be stable at the location where the caliper measurement is made, and the machine crew may be preoccupied with other duties and thus forget to commence the scanning frame. Should this be the case, the caliper profile from the sensor will not be available to perform feedback CD control.

c. the process is extremely dynamic and may fluctuate between large extremes. The behavior of the process may make it difficult to precisely measure the caliper profile. Should this be the case, the caliper profile from the sensor may not be immediately suitable for performing feedback CD control for some time after start up of the paper machine.

For paper machines that run well and without breaks in the line, the need for "fast" recovery at startup may occur days or possibly weeks apart. Arguably, these are the machines that probably don't rely on having a quick recovery to achieve their production through-put. On the other hand, machines with frequent breaks in the line, require a control method that particularly addresses the application conditions described above and delivers the two objectives of CD caliper control. One attempt to address the first application condition is described in U.S. Pat. No. 5,583,782.

As described above, the PI-control of the prior art allows for stabilizing control actions and addresses the thermal inertia of the calender stack. As is well known, PI-control is a method of feedback control that maintains no history of past control actions and relies on the availability of measurements to determine the necessary actuator setpoints. When systems using PI-control are confronted with either or both of the previously described paper machine startup application conditions of scanning frame not commenced or caliper profile not immediately suitable for performing feedback CD control for some time after startup, control actions are suspended. Furthermore, since past control setpoints are not considered, each startup situation is based solely on the current profile measurement. Thus using presently available PI-control systems for CD caliper control may initially drive the actuators from a good previously known steady state solution and then reestablish that solution as a result of continued feedback control. Therefore it is desirable following startup of the paper machine to have a fast recovery of CD caliper control performance.

SUMMARY OF THE INVENTION

A computer program on a tangible computer readable medium for causing one or more operations for recovering cross-direction (CD) caliper control performance during startup of a sheet making machine after an occurrence of a sheet break to be selectably performed, said sheet making machine having feedback CD control, said computer program on a tangible computer readable medium comprising:

computer usable program code configured to allow the selection of one or more of said recovering CD caliper control operations to be performed during startup of a sheet making machine after said sheet break, said selectable operations selected from a group consisting of:

a conditioning of a calender stack mounted on said sheet making machine with said feedback control in a suspend state and using setpoints corresponding to a heating gradient of said calender stack prior to said sheet break;

a conditioning with said feedback CD control in a suspend state of a measurement from a sensor for measuring caliper of a sheet being made by said sheet making machine; and computer usable program code configured to perform said selected operations in a predetermined order during startup of said sheet making machine after said sheet break.

In a sheet making process using a machine having a system responsive to control actions for cross direction feedback caliper control of actuators associated with a calender stack mounted on said machine, a method for recovering caliper control performance during startup of said machine after a sheet break comprising:

using calender stack conditioning with said cross direction feedback caliper control suspended and using setpoints corresponding to a heating gradient of said calender stack prior to said sheet break when a duration of said sheet break exceeds a predetermined period of time and said system for cross direction feedback caliper control of actuators can use said control actions comprising:

suspending said cross direction feedback caliper control;

executing said calender stack conditioning for a specified time duration when said machine starts up comprising:

reapplying to said actuators setpoints saved before said sheet break that represent said heating gradient for conditioning said calender stack to achieve a previously determined caliper profile, said setpoints reapplied to said actuators with a preselected dynamic compensation.

An apparatus for controlling a sheet making machine comprising:

a system including a computing unit for cross direction (CD) feedback caliper control of actuators associated with a calender stack mounted on said sheet making machine;

a sensor for measuring caliper of a sheet being made by said sheet making machine;

a storage medium readable by said computing unit containing a program runnable by said computing unit to execute a method of providing fast CD caliper control recovery of said sheet making machine in the event of a break of said sheet, said method comprising:

monitoring during operation of said sheet making machine in the absence of said sheet break the performance of said CD feedback caliper control and storing CD setpoints corresponding to a CD profile that has a reduction in variability of a caliper error profile;

monitoring the duration of said sheet break; and executing when said sheet making machine starts up and said sheet break duration exceeds a predetermined time period either a conditioning of said calender stack with said CD feedback caliper control in a suspend state and using said stored CD setpoints or a conditioning with said CD feedback caliper control in a suspend state of said measurement from said caliper sensor or both said calender stack conditioning and said caliper sensor measurement conditioning.

In a sheet making process using a machine having a system for cross direction (CD) feedback caliper control of actuators associated with a calender stack mounted on said machine, a method for recovering caliper control performance during startup of said machine after a sheet break comprising:

monitoring during operation of said sheet making machine in the absence of a sheet break the performance of said CD feedback caliper control and storing CD setpoints corresponding to a CD profile that has a reduction in variability of a caliper error profile;

monitoring the duration of a sheet break;

executing when said machine starts up and said sheet break duration exceeds a predetermined time period either a conditioning of said calender stack with said CD feedback caliper control in a suspend state and using said stored CD setpoints or a conditioning with said CD feedback caliper control in a suspend state of a measurement from a caliper sensor or both said calender stack conditioning with said CD feedback caliper control in a suspend state and using said stored CD stepoints and said caliper sensor measurement conditioning with said CD feedback caliper control in a suspend state.

An apparatus for controlling a sheet making machine comprising:

a system including a computing unit for cross direction feedback caliper control of actuators associated with a calender stack mounted on said sheet making machine;

a sensor for measuring caliper of a sheet being made by said sheet making machine;

a PI controller for providing feedback caliper control of said actuators;

a storage medium readable by said computing unit containing a program usable by said computing unit to provide one or more operations for recovering caliper control performance to be selectably performed during startup of said sheet making machine after a sheet break, said selectable operations selected from a group consisting of:

a conditioning of said calender stack with said cross direction feedback caliper control in a suspend state and using setpoints corresponding to a heating gradient of said calender stack prior to said sheet break; and a conditioning with said cross direction feedback caliper control in a suspend state of said measurement from said caliper sensor.

DETAILED DESCRIPTION

Figure 1:
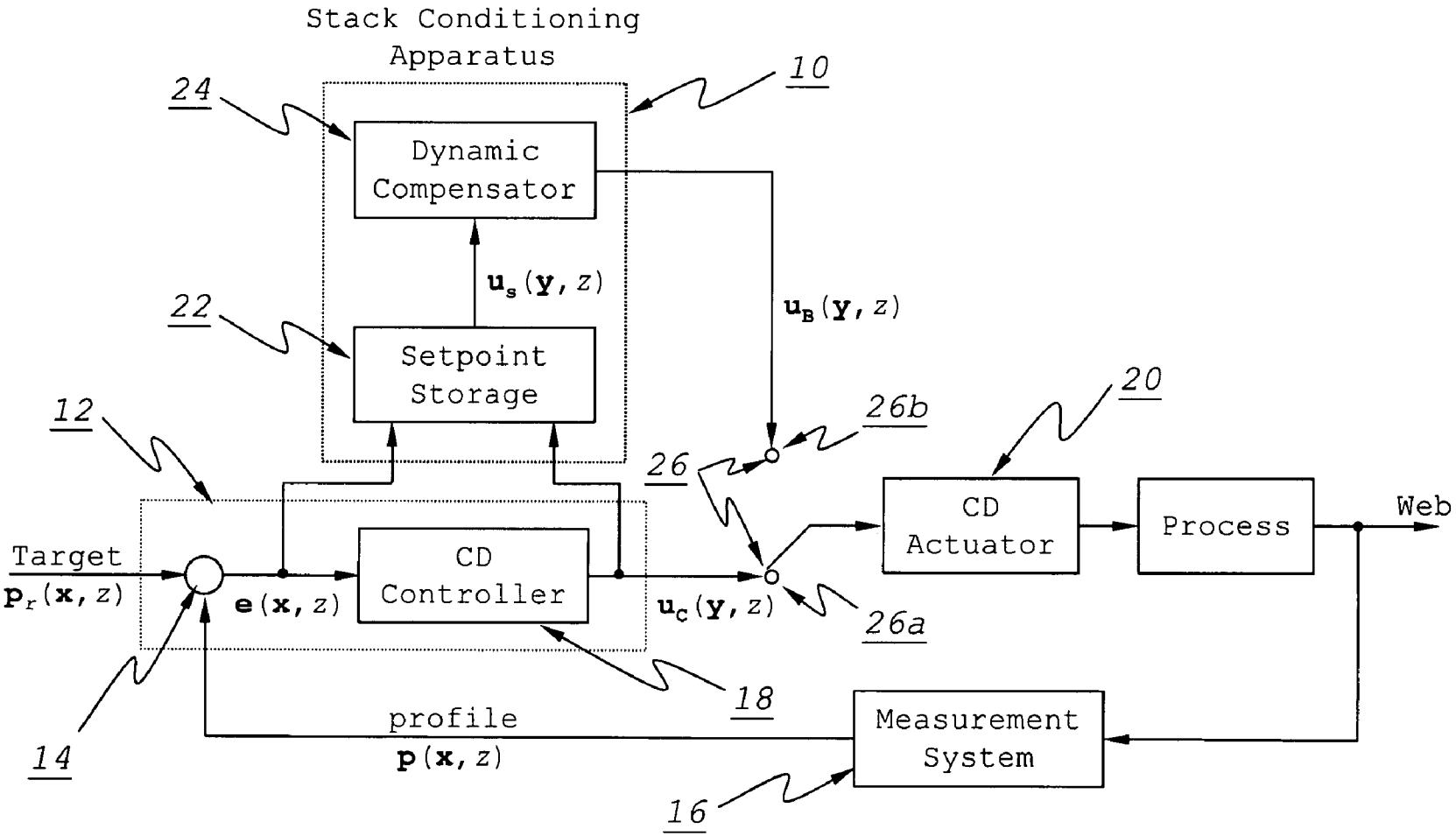
FIG. 1 is a block diagram showing in accordance with the present invention the data flow and interaction between the open loop calender stack conditioning operation and the feedback CD caliper control.

In accordance with the present invention, fast CD caliper control performance recovery following startup of a paper machine is realized by execution under control of the QC system of three operations, each of which are described in more detail below, as follows:

1. Open-loop calender stack conditioning directly adjusts the CD control setpoints in the absence of profile measurements, that is, the feedback CD control is in a suspend state.

2. A measurement conditioning wait period quickly provides an indication of the caliper profile at startup of the machine while continuing to allow the sensor measurement to condition to the rapidly changing process. During this operation, the feedback CD control is in a suspend state.

3. Gain scheduled control parameters, following the reconditioning operation of the calender stack, provide additional aggressive control execution.

After the above operations are executed, the feedback CD caliper control is restored to normal operation. The occurrence of any or all three of the operations following the startup of the machine after a paper break can be enabled or disabled in the QC system at commissioning or at any other time during the operation of the sheet making machine. Operations 1 and 2 have no dependency on each other and if both are enabled then the operations are performed concurrently. Operations 1 and 3 have an order of operation dependency and if both are enabled then operation 1 is performed to completion before operation 3 can commence. Operations 2 and 3 also have an order of operation dependency and if both are enabled then operation 2 is performed to completion before operation 3 can commence.

Open-Loop Calender Stack Conditioning

Open-loop calender stack conditioning deals with boosting the CD control setpoint to re-condition the calender stack to a previous operation state. Since this operation is performed in open-loop with the feedback CD caliper control in a suspend state it does not require the availability of either a profile measurement or activities associated with operation 2 (measurement conditioning wait time). Instead, the open-loop calender stack conditioning operation is dependent on conditions that dictate whether control actions will be used by the CD actuator system. These conditions, referred to hereinafter as "pre-conditions", include, but are not limited to, the following:

CD actuators fully extended to their normal operating position—this is the position that is up against, but not touching, one of the calender rolls in the stack; and System status of the actuator system—the system must be in remote ready to accept and deliver the control actions.

The steps associated with the open-loop calender stack conditioning operation are executed in the QC system and include the following:

1. Monitoring during operation of the machine in the absence of a sheet break the caliper profile control performance and storing the CD setpoints corresponding to improved performance. Profile control performance is determined by the variability of the caliper error profile. The caliper error profile is the difference between the caliper profile and the target or desired value of the caliper profile. Improved performance is judged by reduction in the profile variability value. The stored CD setpoints represent the heating gradient for conditioning the calender stack to achieve the associated profile performance.

2. Monitoring the occurrence of a machine stop condition, that is, a sheetbreak signal.

3. Monitoring the duration of the sheetbreak. If the sheetbreak duration is sufficiently long, the calender stack conditioning operation is scheduled so that it can be executed when the machine starts up. On short breaks, the calender stack condition may not change enough to warrant re-conditioning. A measure that has been used to specify the sheetbreak duration is a desired "recovery time". As used herein, the recovery time is the time between the first post-break caliper error profile update and when the caliper error profile variability reaches the pre-break variability level. The difference between open-loop response time and recovery time is that the open-loop response time is measured based on a step change in the actuator setpoint, whereas, recovery time can be influenced by the chosen actuator setpoint trajectory which may not be a step trajectory.

4. Checking the pre-conditions that define whether the CD actuator system is in an okay state for CD setpoints to be outputted to the CD actuators. As described above, the pre-conditions include but are not limited to the CD actuators being extended and the actuator system is in remote.

5. Suspending feedback CD caliper control in preparation to executing the calender stack conditioning operation described in step 6. The feedback CD caliper control is suspended during the stack conditioning operation to prevent that control from driving the CD setpoints away from a previously known good operating state.

6. Executing the calender stack conditioning operation when the machine starts up. The saved setpoints, which represent the settings corresponding to heating gradient of the calender stack, are re-applied with dynamic compensation. The dynamically compensated setpoints are nominally updated every five (5) seconds in an open-loop sense. Various types of dynamic compensation are offered, and these are discussed below. Since the dynamically compensated CD control setpoints reach their final value at time infinite, the stored CD setpoints are sent to the CD actuators in this step of the stack conditioning operation. The calender stack conditioning operation is typically executed for the desired recovery time (as defined in step 3 above) to allow for the dynamic compensation to be effective and the stack nip pressure to be re-established. For a process that exhibits an open-loop response time of 10 minutes, a recovery time of 15 minutes may be reasonable for executing the stack conditioning operation. The terms "open-loop response time" and "recovery time" are based on the definitions previously given herein.

7. Releasing, at the end of the calender stack conditioning operation, suspension of feedback CD caliper control and restoring that feedback control to the normal operating mode.

The data flow and interaction between the open-loop calender stack conditioning operation and the feedback CD caliper control is illustrated in FIG. 1. FIG. 1 shows open loop stack conditioning apparatus 10 and the feedback CD caliper control 12. A device 26, shown symbolically as a switch in FIG. 1, is controlled to suspend the feedback CD caliper control 12 when the open loop stack conditioning 10 is in use and vice versa. Switch 26 is shown in FIG. 1 in position 26*a* for feedback CD caliper control. Open loop stack conditioning is in use when the switch is in position 26*b*.

As is shown in FIG. 1, the caliper measurement profile of the paper web provided by measurement system 16 is used in combination with the target or desired value of the caliper at summation element 14 to provide an error signal input to a CD controller 18 which is part of feedback CD caliper control 12. During operation of feedback CD caliper control, the output of controller 18, which is the amount that the CD actuator 20 should be adjusted to bring the web into alignment with the desired caliper profile, is transmitted to the CD actuator 20 and to the setpoint storage 22. The error signal output of summation element 14 is also transmitted to the setpoint storage 22 to monitor the control performance and determine whether the CD setpoint output of CD controller 18 is saved in the stack conditioning apparatus 10.

When the switch 26 is in position 26*b*, open loop stack conditioning is in use. In that position the output of the CD controller 18 is not transmitted to CD actuator 20. Instead, the output of dynamic compensator 24 is transmitted to CD actuator 20. Thus the combination of setpoint storage 22 and dynamic compensator 24 together comprise the open loop stack conditioning apparatus 10. Therefore, during the open-loop stack conditioning operation, the output of the apparatus 10 is provided as an input to the CD actuator 20.

The setpoint dynamic compensation provided by open-loop stack conditioning 10 is achieved with a lead-lag transfer function. This transfer function is represented by the equation $$G(s) = K\frac{t_1 s + 1}{t_2 s + 1},$$

where K is the steady-state gain, $t_1$ is the numerator dynamic and $t_2$ is the denominator dynamic. Depending on the values specified by the process engineer for K, $t_1$, and $t_2$, the open-loop CD setpoint values can be adjusted with either a leading, step, or lagging output trajectory. The input to the dynamic compensator 24 is the stored setpoint in storage 22. For fast CD caliper profile recovery time, the open-loop CD setpoint values are adjusted with a leading output trajectory. For completeness, a full description is provided for all three trajectory cases.

A leading output initially boosts the setpoint beyond the steady-state value (the input value to the transfer function, or the stored CD setpoint values) and dynamically resets it over time. To achieve a leading action, the gain K is set to 1 and the numerator dynamic $t_1$ is set larger than the denominator dynamic $t_2$. Typically, the numerator dynamic $t_1$ is set to the caliper profile open-loop response time and the denominator dynamic $t_2$ is set to a value smaller than the value of $t_1$ to achieve a fast caliper profile recovery time. If the CD setpoints generated from the dynamic compensator 24 are not output limited, the ratio between $t_1$ and $t_2$ ($t_1/t_2$) represents how much faster the caliper profile response can be made relative to its open-loop response time $t_1$.

Figure 2B:
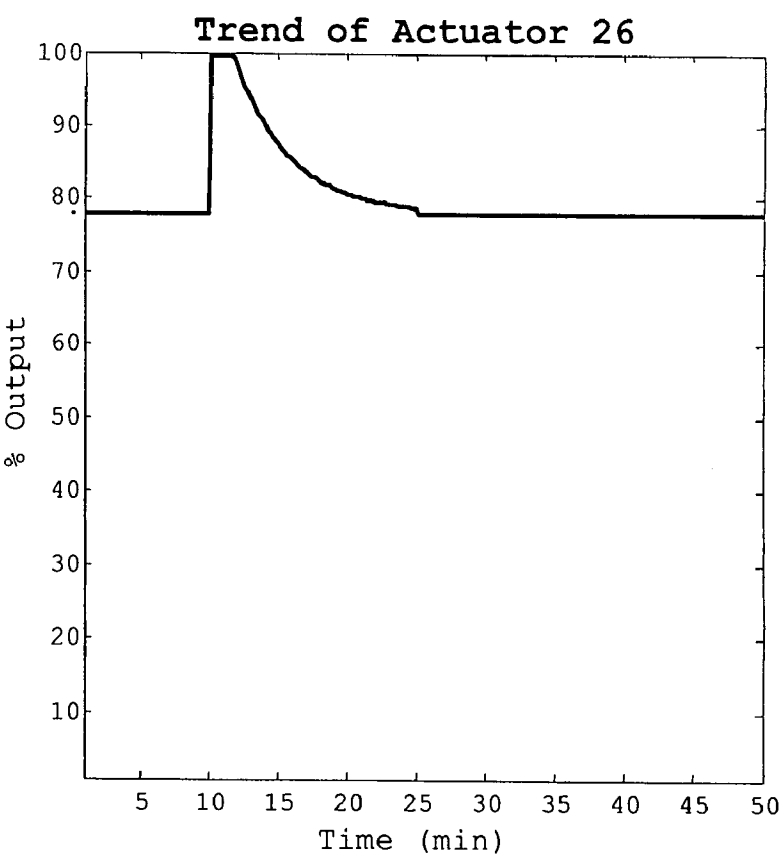
FIGS. 2*a* and 2*b* illustrate an example of the stack conditioning apparatus dynamic compensator leading action of the present invention.
Figure 2A:
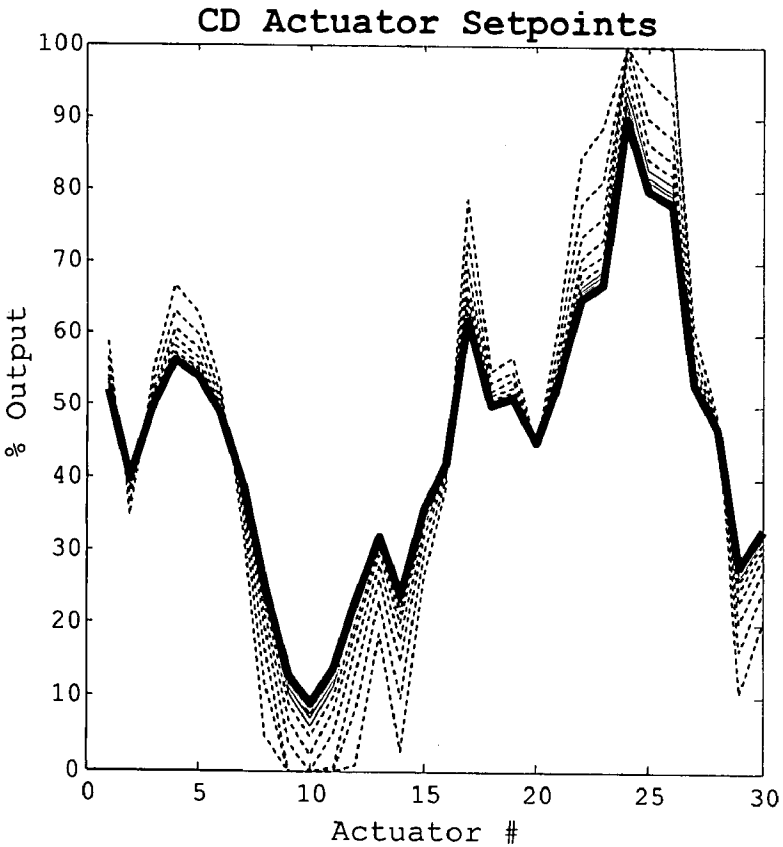

A leading action is illustrated in FIGS. 2*a* and 2*b* for a CD setpoint array of 30 control zones. In FIG. 2*a,* the heavy thickness line represents both the final setpoint values applied by the stack conditioning operation 10 prior to returning the feedback CD caliper control 12 to its normal operating state and the stored setpoint values that are used as an input to the compensator 24. The thin dashed lines represent some of the setpoint values over time. In FIG. 2*b,* the setpoint values are trended over time for actuator number 26.

The step output sets the setpoint values to a level proportional to the stored setpoint values, for example, 1.10 times the stored setpoint value, and is held at that value over time. To achieve a step action, the gain K is set to the proportional value desired and the numerator dynamic $t_1$ is set equal to the denominator dynamic $t_2$.

Figure 3B:
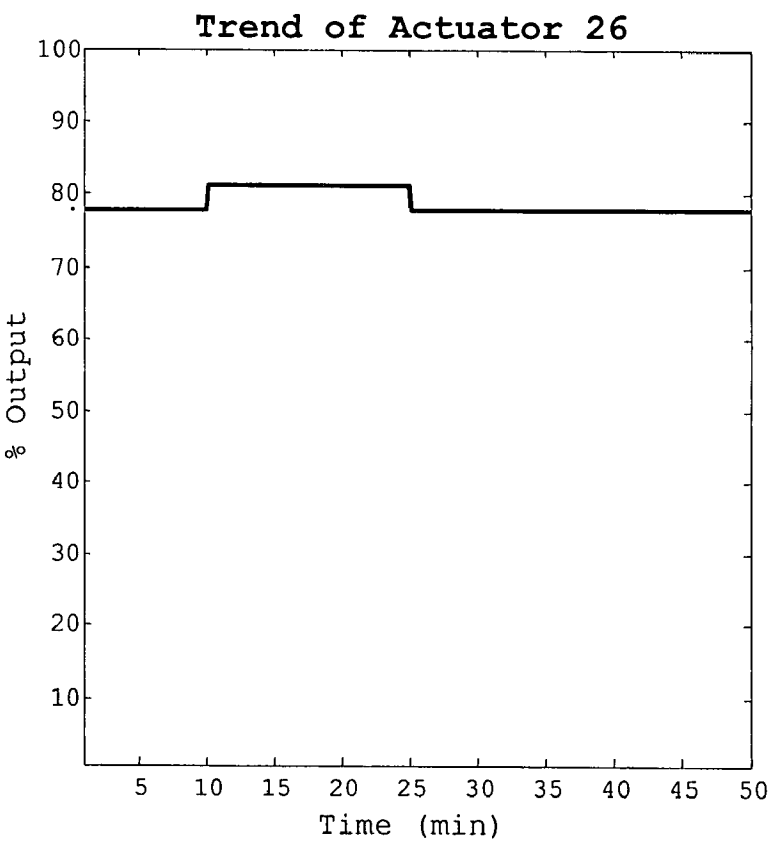
FIGS. 3*a* and 3*b* illustrate an example of the stack conditioning apparatus dynamic compensator step action of the present invention.
Figure 3A:
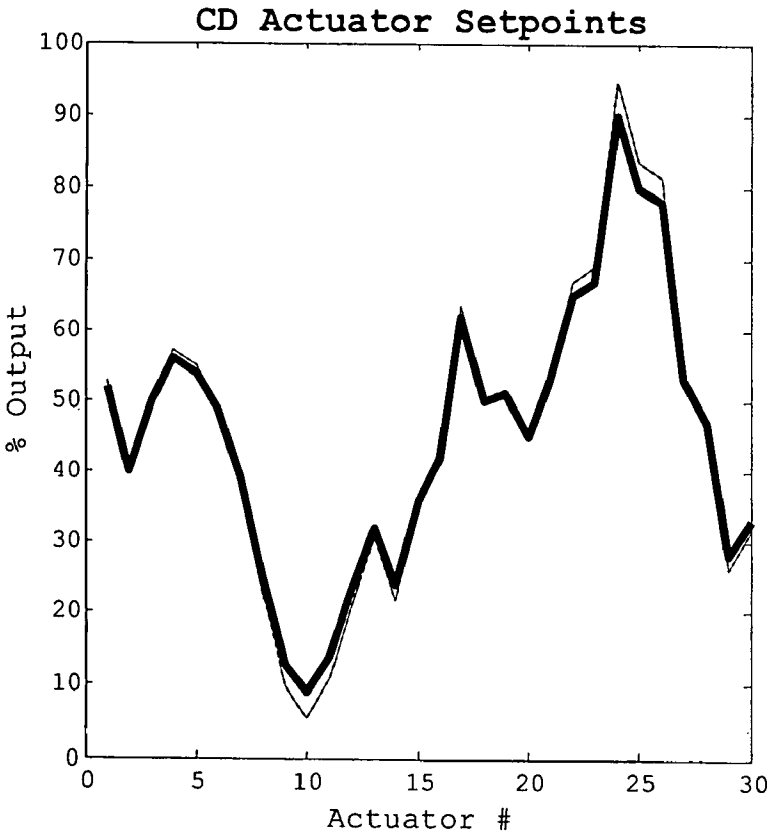

A step action is illustrated in FIGS. 3*a* and 3*b* for a CD setpoint array of 30 control zones. As with FIG. 2*a,* the heavy thickness line in FIG. 3*a* represents both the final setpoint values and the stored setpoint values that are used as the input to compensator 24, and the thin dashed line represents some of the setpoint values over time. In FIG. 3*b,* the setpoint values are trended over time for actuator number 26.

The lagging output gradually changes the setpoint values to approach the steady-state value (the input value to the transfer function, or the stored CD setpoint values) over time. To achieve a lagging action, the gain K is set to 1 and the numerator dynamic $t_1$ is set smaller than the denominator dynamic $t_2$. Typically, the numerator dynamic $t_1$ is set to the caliper profile open-loop response time and the denominator dynamic $t_2$ is set to a value larger than the value of $t_1$ to achieve a slow caliper profile recovery time. The ratio between $t_1$ and $t_2$ ($t_1/t_2$) represents how much slower the caliper profile response can be made relative to its open-loop response time $t_1$.

Figure 4B:
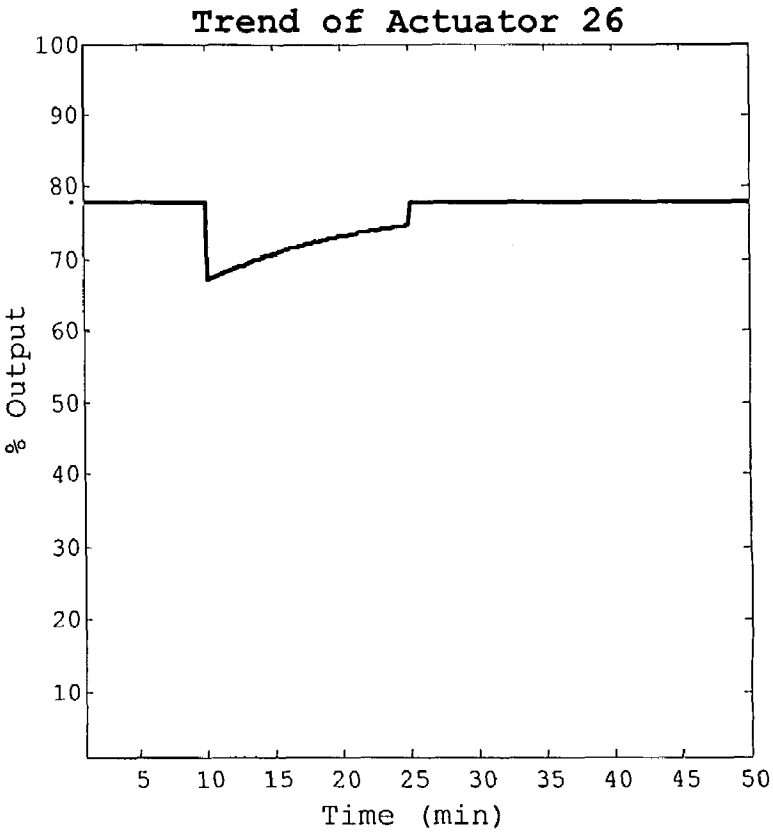
FIGS. 4*a* and 4*b* illustrate an example of the stack conditioning apparatus dynamic compensator lagging action of the present invention.
Figure 4A:
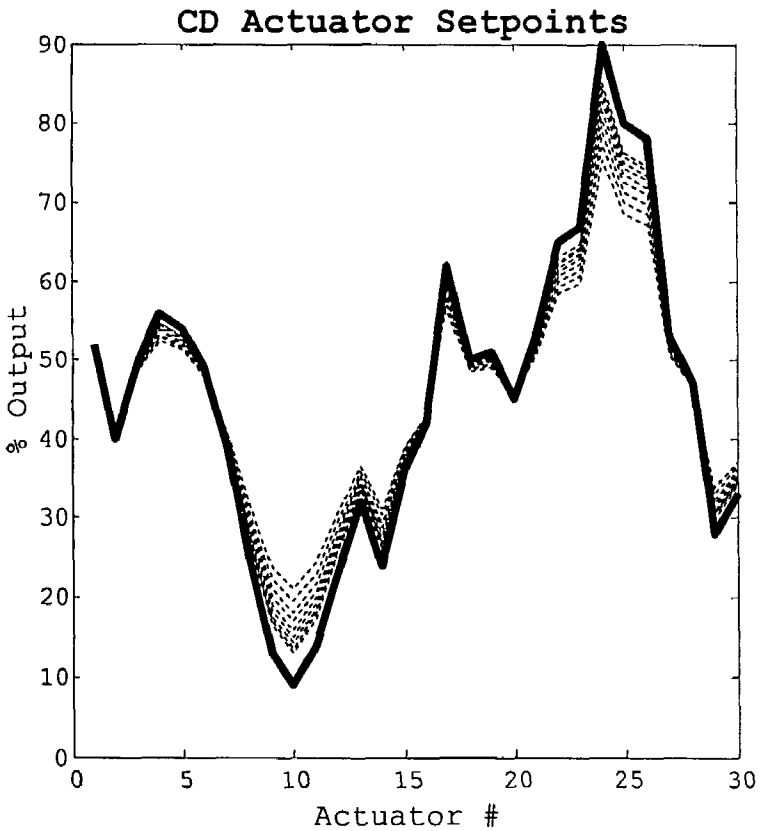

A lagging action is illustrated in FIGS. 4*a* and 4*b* for a CD setpoint array of 30 control zones. As with FIG. 2*a,* the heavy thickness line in FIG. 4*a* represents both the final setpoint values and the stored setpoint values that are used as the input to compensator 24, and the thin dashed lines represent some of the setpoint values over time. In FIG. 4*b,* the setpoint values are trended over time for actuator number 26.

Measurement Conditioning Wait Time

This operation deals primarily with suspending the feedback CD control to allow the measurement system time to re-establish a stable and reliable profile measurement before feedback control actions are taken against a rapidly changing process. Measurement conditioning wait time is executed concurrently with the stack conditioning operation 10, since the stack conditioning operation executes in an open-loop. The steps associated with the measurement conditioning wait time operation include the following:

1. Monitoring the occurrence of a machine stop condition, that is a sheetbreak signal.

2. Monitoring the duration of the sheetbreak. If the sheetbreak duration is sufficiently long, the measurement conditioning operation is scheduled so that it can be executed when the machine starts up and when the scanner is returned to a state that can commence scanning across the web. The evaluated sheetbreak duration is typically set to be the same as that used for the open-loop calender stack conditioning operation so that if one operation is performed so is the other. It should be appreciated that each of the two conditions (measurement conditioning and open loop calender stack conditioning) only begins after the end of the actual sheetbreak duration, that is, the clearing of the sheetbreak. Thus if the sheetbreak duration for each of the two conditions are not set to be the same, the condition that has the shorter sheetbreak duration will, if that duration is satisfied, operate and the other condition will not operate as its sheetbreak duration cannot be satisfied.

3. Executing the measurement conditioning wait time operation when the machine starts up. Initially, this operation suspends the feedback CD control for a specifiable number of scans across the web. These initial specifiable number of scans of the web are used to produce process snapshot data of the caliper profile that is representative of the startup condition. The snapshot data is updated at the end of every crossing of the web so that manual operational decisions can be made, while the calender stack nip pressure is conditioned with the stack conditioning operation. Following the initial scans of the sheet, a sensor standardize event is scheduled. Upon completion of the standardize event, suspension of the feedback CD caliper control is continued for a specifiable number of scans across the web. These scans of the web produce filtered profile data that is representative of a stable caliper measurement resulting from the re-conditioned calender stack.

Figure 5:
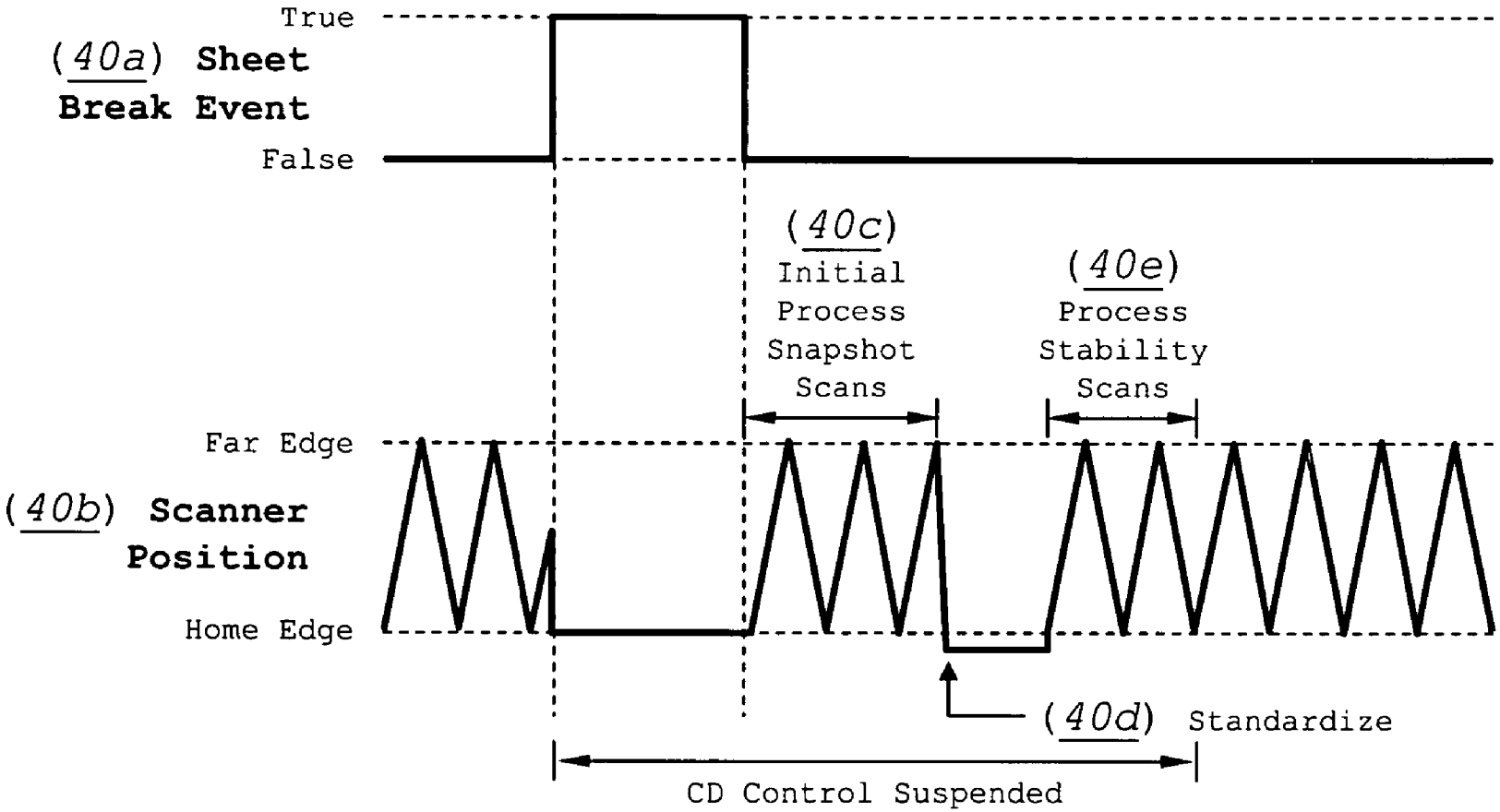
FIG. 5 illustrates the series of CD control and scanner events commanded by the measurement condition operation of the present invention.

The sequence of events associated with the measurement condition wait time operation is illustrated in the diagram shown in FIG. 5 where a sheetbreak event is shown at 40*a* and the position of the scanner is shown at 40*b.* As is shown at 40*b,* the scanner stops scanning upon the occurrence 40*f* of the sheetbreak and resumes scanning at the end 40*g* of the sheetbreak. A selectable number of initial process snapshot scans 40*c* starting after the end of the sheetbreak are followed by the standardize event 40*d* which in turn is followed by a selectable number of process stability scans 40*e* at the end of which CD control resumes. The CD control is suspended during the duration of the sheetbreak event, the initial process snapshot scans, the standardize event and the process stability scans.

Gain Scheduled Control Parameters

This operation deals with changing the feedback control tuning parameters of the PI-controller and is performed in a closed-loop. If either or both of the calender stack conditioning and measurement conditioning wait time operations are executed, then the gain scheduled control parameter operation is executed only after completion of those operations. Since closed-loop control is dependent on stable and reliable measurements and performs best when the process is properly conditioned, the gain scheduled control parameter operation is typically executed as a follow up operation to either or both of the other two operations.

When this operation is executing, the values of a set of PI-controller parameters, including but not limited to the PI-controller gain, reset time, and execution frequency, are changed. Each change event of the controller parameters represent a new gain scheduling phase. Each gain scheduling phase is supported by storage of controller parameters, in the QC system, used during execution of the phase and a duration for executing the phase. The duration of each gain scheduling phase is determined by how many control actions are required to complete execution of the phase. The next phase is executed when the number of control actions are fulfilled for the current execution phase. When all gain scheduling phases are fulfilled, the gain scheduled control operation is terminated and CD control is permitted to return to normal operation.

Mill Results

Figure 6A:
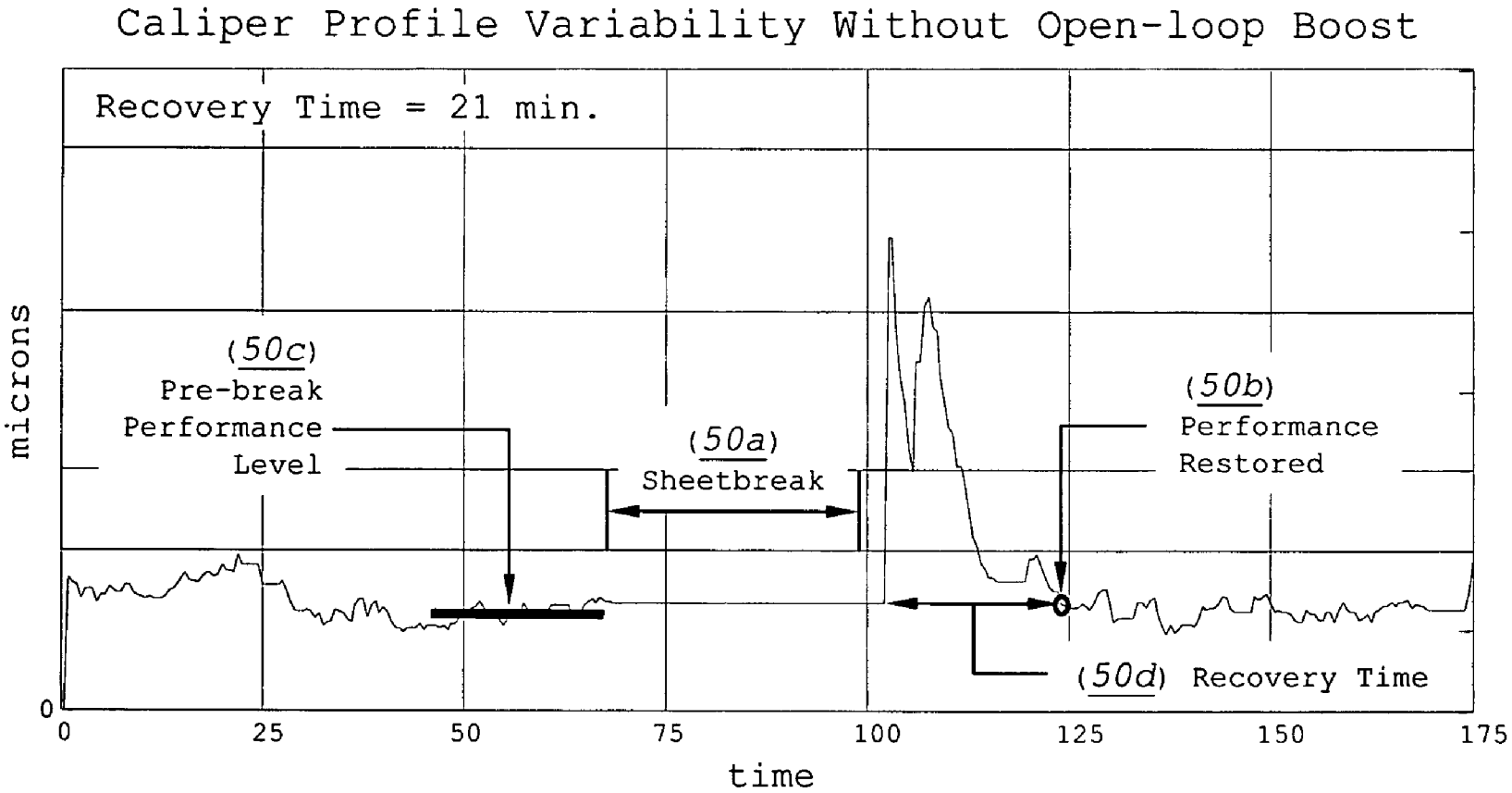
FIGS. 6*a* and 6*b* presents examples of caliper profile recovery performance during a machine startup when using feedback CD caliper control and using the stack conditioning operation of the present invention.
Figure 6B:
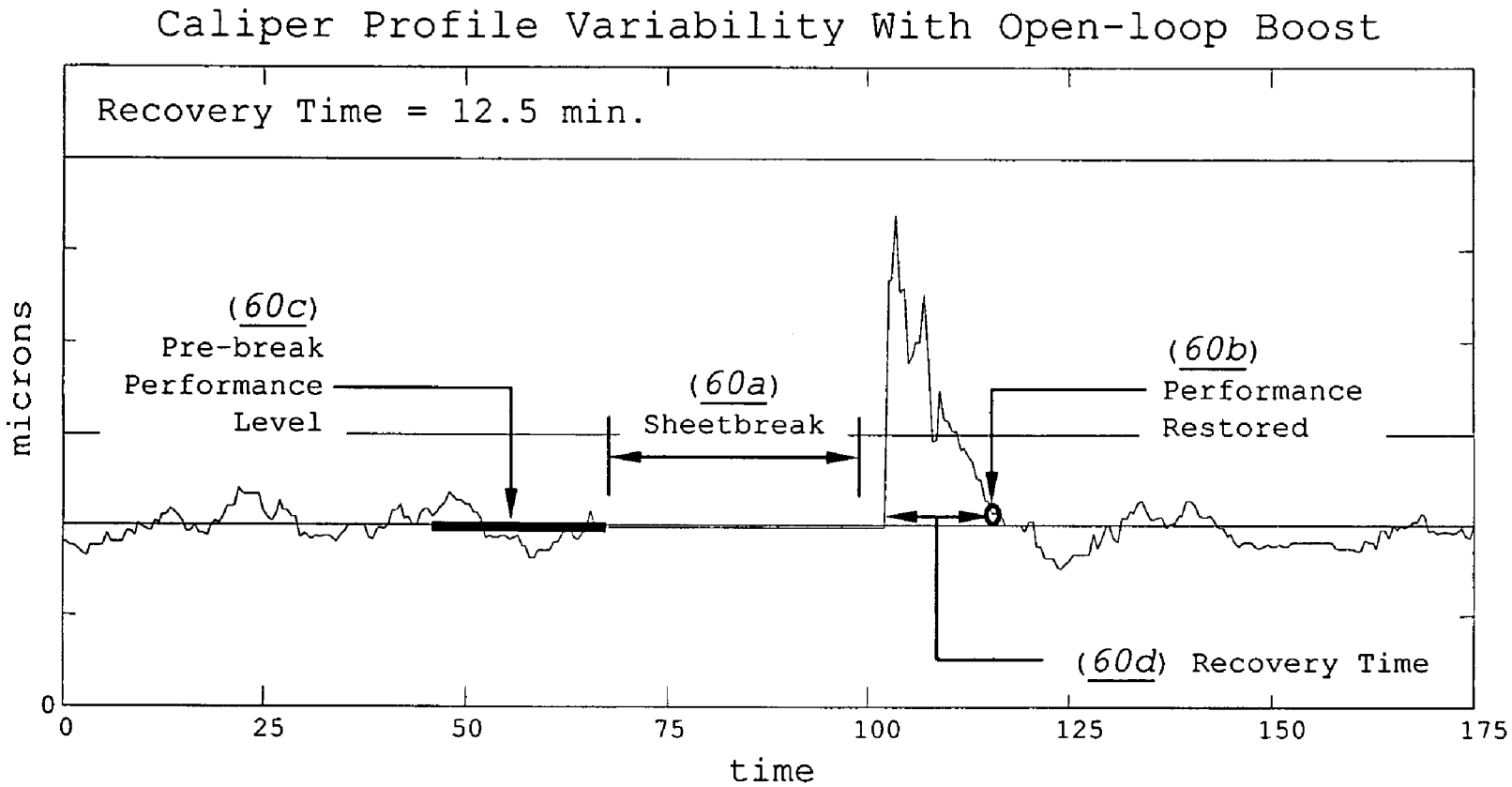

Testing of the open-loop calender stack conditioning operation was performed on a paper machine equipped with a calender stack induction heater consisting of 47 CD zones. The calender stack conditioning operation was set to execute only on sheetbreak durations longer than 15 minutes. For break durations shorter than 15 minutes, normal CD caliper control execution with PI-control was performed. Typical CD caliper profile variability recovery following a sheetbreak using feedback CD caliper control and using the stack conditioning operation is illustrated in FIGS. 6*a* and 6*b* respectively. The events associated with the sheetbreak recovery occurrences are illustrated in the diagrams shown in FIGS. 6*a* and 6*b* where the occurrence of the sheetbreak events are shown at 50*a* and 60*a*, and the position of restored performance is shown at 50*b* and 60*b*. The pre-break CD control performance levels 50*c* and 60*c* are used to determine the sheetbreak recovery times 50*d* and 60*d*. The break recovery time identified in FIGS. 6*a* and 6*b* is based on the previously given definition of "recovery time".

The following table documents additional sheetbreak recovery time with the calender stack conditioning operation active.

| Experiment # | Break Duration (mins) | Recovery Time (mins) |
|---|---|---|
| 1 | 17 | 13 |
| 2 | 21.5 | 12.5 |
| 3 | 20.5 | 12.5 |
| 4 | 25 | 13 |

-continued

| Experiment # | Break Duration (mins) | Recovery Time (mins) |
|---|---|---|
| 5 | 80.5 | 15.5 |
| 6 | 18 | 18 |
| 7 | 70 | 12 |
| 8 | 27 | 12.5 |
| 9 | 28.5 | 13.5 |
| 10 | 27.5 | 15 |
| 11 | 15.5 | 16 |
| 12 | 25 | 12 |
| 13 | 18 | 12.5 |

As can be appreciated by those of ordinary skill in the art, control strategy of the present invention may be implemented in software and the software may either be stored on a computing device, such for example as a desktop or laptop computer or an engineering workstation, or available on computer readable media, such as for example a CD-ROM, a DVD or a flash drive, for loading into and storing on the computing device.

Figure 7:
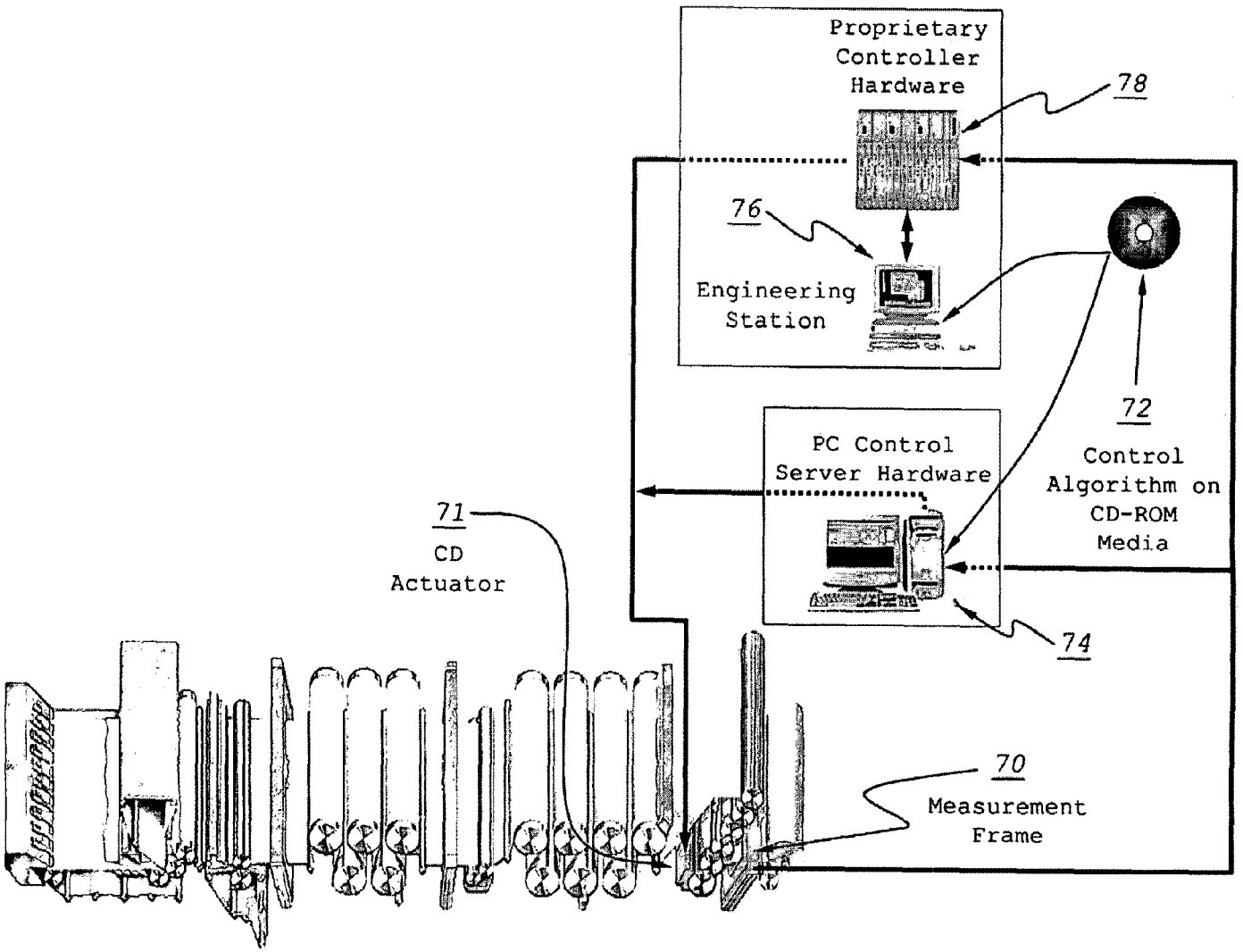
FIG. 7 shows a diagram of a system that may be used to implement the control strategy of the present invention.

Referring now to FIG. 7, there is shown a diagram of a system that may be used to implement the control strategy of the present invention. The system in FIG. 7 shows two alternatives for a computing device, namely, a personal computer control server hardware 74 or a engineering station 76 connected to a proprietary hardware controller 78. FIG. 7 also show the measurement frame 70 and the CD actuator 71.

As is shown in FIG. 7, the control strategy of the present invention described above is on a computer readable media such as CD-ROM 72 which can be read by the personal computer 74 or the engineering station 76 to thereby load the control strategy into either of those computing devices. The selected computing device executes the instructions stored in the computer program on the CD-ROM 72 and the output of either PC control server hardware 74 or proprietary controller hardware 78 is connected to CD actuator 71 to thereby implement the control strategy of the present invention for measurement frame 70.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A computer program stored on tangible computer readable media for causing one or more operations for recovering cross-direction (CD) caliper control performance during startup of a sheet making machine after an occurrence of a sheet break to be selectably performed, said sheet making machine having feedback CD control, said computer program comprising:

computer usable program code configured to allow the selection of one or more of said recovering CD caliper control operations to be performed during startup of said sheet making machine after said sheet break, said selectable operations selected from a group consisting of:

a conditioning of a calender stack mounted on said sheet making machine with said feedback CD control in a suspend state using setpoints corresponding to a heating gradient of said calender stack prior to said sheet break and a conditioning with said feedback CD control in a suspend state of a measurement from a sensor for measuring caliper of a sheet being made by said sheet making machine; and computer usable program code configured to perform said selected operations in a predetermined order during startup of said sheet making machine after said sheet break.

2. The computer program stored on tangible computer readable media of claim 1 wherein said selected operations are performed in said predetermined order only after a time duration measured from the occurrence of said sheet break has elapsed, said computer program on a tangible computer readable media further comprising:

computer usable program code configured to allow said time duration to be selected.

3. The computer program stored on tangible computer readable media of claim 2 further comprising computer usable program code configured to perform both said conditioning of said calender stack with said feedback CD control in a suspend state using setpoints corresponding to said heating gradient of said calender stack prior to said sheet break and said conditioning with said feedback CD control in a suspend state of said measurement from said sensor for measuring caliper of said sheet concurrently when both of said conditionings are selected and said time duration for both of said conditionings are selected to be identical and said identical time duration has elapsed.

4. The computer program stored on tangible computer readable media of claim 1 further comprising:

computer usable program code configured to allow selection of a time duration measured from said occurrence of said sheet break; and computer usable program code configured to perform said selected operations in said predetermined order only after said selected time duration measured from said occurrence of said sheet break has elapsed.

5. The computer program stored on tangible computer readable media of claim 1 further comprising computer usable program code configured to monitor an occurrence of a signal from said sheet making machine indicative that said sheet break has occurred.

6. The computer program stored on tangible computer readable media of claim 5 further comprising computer usable program code configured to monitor the duration in time of said sheet break after said sheet break signal has occurred.

7. The computer program stored on tangible computer readable media of claim 6 further comprising computer usable program code configured to allow selection of a time duration measured from said occurrence of said sheet break signal, said computer usable program code performing said selected operations in said predetermined order during startup of said sheet making machine when said selected time duration has elapsed and said sheet making machine is restarted.

8. The computer program stored on tangible computer readable media of claim 2 wherein said conditioning of said calender stack with said feedback CD control in a suspend state using setpoints corresponding to said heating gradient of said calender stack prior to said sheet break and said conditioning with said feedback CD control in a suspend state of said measurement from said sensor for measuring caliper of said sheet being made by said sheet making machine are both selected and said time is selected to be different for each of said conditionings and said computer program product on a tangible computer readable media further comprises computer usable program code configured to perform that one of said conditionings whose selected time duration has first elapsed.

9. The computer program stored on tangible computer readable media of claim 1 further comprising computer usable program code configured to first perform when selected said conditioning of said calender stack with said feedback CD control in a suspend state using setpoints corresponding to said heating gradient of said calender stack prior to said sheet break to completion and then perform a closed loop change in a set of control tuning parameters of a PI controller.

10. The computer program stored on tangible computer readable media of claim 1 further comprising computer usable program code configured to first perform when selected said conditioning with said feedback CD control in a suspend state of said measurement from said sensor for measuring caliper to completion and then perform a closed loop change in a set of control tuning parameters of a PI controller.

11. In a sheet making process using a machine having a system responsive to control actions for cross direction feedback caliper control of actuators associated with a calender stack mounted on said machine, a method for recovering caliper control performance during startup of said machine after a sheet break comprising:

using calender stack conditioning with said cross direction feedback caliper control suspended using setpoints corresponding to a heating gradient of said calender stack prior to said sheet break when a duration of said sheet break exceeds a predetermined period of time and said system for cross direction feedback caliper control of actuators can use said control actions comprising:

suspending said cross direction feedback caliper control; and executing said calender stack conditioning for a specified time duration when said machine starts up comprising:

reapplying to setpoints of said actuators saved before said sheet break that represent said heating gradient for conditioning said calender stack to achieve a previously determined caliper profile, said setpoints reapplied to said actuators with a preselected dynamic compensation.

12. The method of claim 11 further comprising preselecting said dynamic compensation as either leading, step or lagging compensation.

13. The method of claim 11 wherein said dynamic compensation has a lead-lag transfer function.

14. The method of claim 11 further comprising determining if said system for cross direction feedback caliper control of actuators can use said control actions.

15. The method of claim 11 further comprising releasing at the end of said specified time duration for said calender stack conditioning suspension of said cross direction feedback caliper control.

16. An apparatus for controlling a sheet making machine comprising:

a system including a computing unit for cross direction (CD) feedback caliper control of actuators associated with a calender stack mounted on said sheet making machine;

a sensor for measuring caliper of a sheet being made by said sheet making machine; and a storage medium readable by said computing unit containing a program runnable by said computing unit to execute a method of providing fast CD caliper control recovery of said sheet making machine in the event of a break of said sheet, said method comprising:

monitoring during operation of said sheet making machine in absence of said sheet break a performance of said CD feedback caliper control and storing CD setpoints corresponding to a CD profile that has a reduction in variability of a caliper error profile;

monitoring the duration of said sheet break; and executing when said sheet making machine starts up and said sheet break duration exceeds a predetermined time period either a conditioning of said calender stack with said CD feedback caliper control in a suspend state and using stored CD setpoints or a conditioning with said CD feedback caliper control in a suspend state of said measurement from said caliper sensor or both said calender stack conditioning and said caliper sensor measurement conditioning.

17. The apparatus of claim 16 further comprising a PI controller having control tuning parameters and wherein said method further comprises executing in a closed loop after execution is completed of either said conditioning of said calender stack with said CD feedback caliper control in a suspend state and using stored CD setpoints or said conditioning with said CD feedback caliper control in a suspend state of said measurement from said caliper sensor or both said calender stack conditioning with said CD feedback caliper control in a suspend state and using stored CD setpoints and said caliper sensor measurement conditioning or when neither said conditioning of said calender stack with said CD feedback caliper control in a suspend state and using stored CD setpoints or said conditioning of said measurement from caliper sensor is executed a change in a set of said PI controller control tuning parameters.

18. In a sheet making process using a machine having a system for cross direction (CD) feedback caliper control of actuators associated with a calender stack mounted on said machine, a method for recovering caliper control performance during startup of said machine after a sheet break comprising:

monitoring during operation of said machine in absence of said sheet break the performance of said CD feedback caliper control and storing CD setpoints corresponding to a CD profile that has a reduction in variability of a caliper error profile;

monitoring the duration of said sheet break; and executing when said machine starts up and said sheet break duration exceeds a predetermined time period either a conditioning of said calender stack with said CD feedback caliper control in a suspend state and using said stored CD setpoints or a conditioning with said CD feedback caliper control in a suspend state of a measurement from a caliper sensor or both said calender stack conditioning with said CD feedback caliper control in a suspend state and using stored CD setpoints and said caliper sensor measurement conditioning with said CD feedback caliper control in a suspend state.

19. An apparatus for controlling a sheet making machine comprising:

a system including a computing unit for cross direction feedback caliper control of actuators associated with a calender stack mounted on said sheet making machine;

a sensor for measuring caliper of a sheet being made by said sheet making machine;

a PI controller for providing feedback caliper control of said actuators; and a storage medium readable by said computing unit containing a program usable by said computing unit to provide one or more operations for recovering caliper control performance to be selectably performed during startup of said sheet making machine after a sheet break, said selectable operations selected from a group consisting of:

a conditioning of said calender stack with said cross direction feedback caliper control in a suspend state and using setpoints corresponding to a heating gradient of said calender stack prior to said sheet break and a conditioning with said cross direction feedback caliper control in a suspend state of said measurement from said caliper sensor.

* * * * *

UNITED STATES PATENT AND TRADEMARK OFFICE

CERTIFICATE OF CORRECTION

PATENT NO. : 7,584,013 B2
APPLICATION NO. : 11/414922
DATED : September 1, 2009
INVENTOR(S) : Tran et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this

Fourteenth Day of September, 2010

David J. Kappos

David J. Kappos
*Director of the United States Patent and Trademark Office*